US009657488B2

(12) United States Patent
Pichon et al.

(10) Patent No.: US 9,657,488 B2
(45) Date of Patent: May 23, 2017

(54) SWIMMING POOL CLEANING APPARATUS WITH EXTRACTABLE FILTRATION DEVICE

(71) Applicant: ZODIAC POOL CARE EUROPE, Paris (FR)

(72) Inventors: Philippe Pichon, Villeneuve de Riviere (FR); Rémi Deloche, Toulouse (FR); Philippe Blanc-Tailleur, Toulouse (FR)

(73) Assignee: ZODIAC POOL CARE EUROPE, Paris (FR)

( * ) Notice: Subject to any disclaimer, the term of this patent is extended or adjusted under 35 U.S.C. 154(b) by 147 days.

(21) Appl. No.: 14/521,521

(22) Filed: Oct. 23, 2014

(65) Prior Publication Data

US 2015/0114900 A1 Apr. 30, 2015

(30) Foreign Application Priority Data

Oct. 25, 2013 (FR) ..... 13 60479

(51) Int. Cl.
*E04H 4/16* (2006.01)

(52) U.S. Cl.
CPC ..... *E04H 4/1654* (2013.01)

(58) Field of Classification Search
CPC ..... E04H 4/1654
USPC ..... 210/167.16, 167.17, 167.19, 238, 416.1, 210/416.2; 15/1.7
See application file for complete search history.

(56) References Cited

U.S. PATENT DOCUMENTS

| | | | | |
|---|---|---|---|---|
| 3,422,478 | A † | 1/1969 | Osborne | |
| 4,338,697 | A * | 7/1982 | Broadwater | E04H 4/1609 15/1.7 |
| 5,830,350 | A * | 11/1998 | Voss | E04H 4/1272 210/167.12 |
| 2013/0152317 | A1* | 6/2013 | Erlich | B08B 9/08 15/1.7 |

FOREIGN PATENT DOCUMENTS

| | | |
|---|---|---|
| EP | 1074678 | 2/2001 |
| EP | 1916359 | 8/2008 |
| EP | 2163711 | 3/2010 |
| EP | 2235298 | 10/2010 |
| FR | 2925557 | 9/2013 |

OTHER PUBLICATIONS

International Patent Application No. PCT/FR2014/052710 , International Search Report, mailed Mar. 10, 2015, 3 pages.

* cited by examiner
† cited by third party

*Primary Examiner* — Fred Prince
(74) *Attorney, Agent, or Firm* — Kilpatrick Townsend & Stockton LLP; Dean W. Russell

(57) ABSTRACT

The invention relates to a swimming pool cleaning apparatus comprising:

Figure 1:
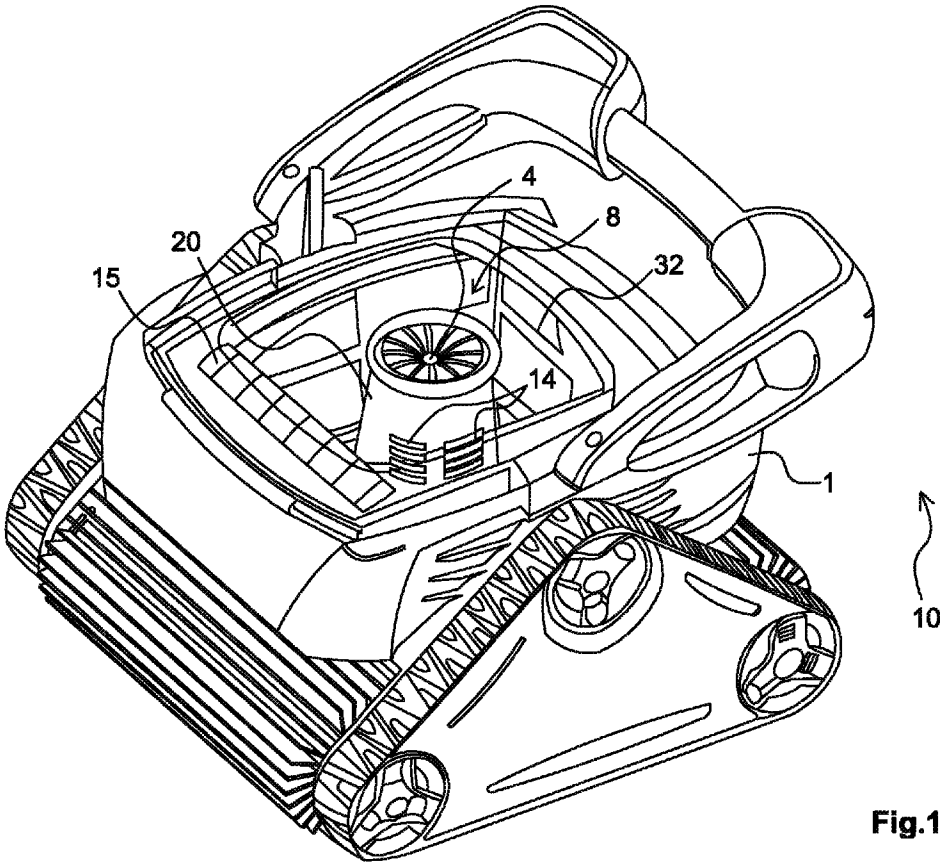

at least one hydraulic liquid circulation circuit between at least one liquid inlet (3) and at least one liquid outlet (4), and through a removable filtration device of the cleaning apparatus.

The filtration device comprises at least one filtration chamber (8) comprising:

a cover (2), a filtration basket (17), the hydraulic fluid circulation circuit comprising a liquid discharge tube (20) emerging from the apparatus through an opening (4) formed in the cover (2) of the filtration device, (Continued)

the filtration basket (17) comprising a central filtering wall (9) surrounding the liquid discharge tube (20) over at least a part of its length.

22 Claims, 6 Drawing Sheets

SWIMMING POOL CLEANING APPARATUS WITH EXTRACTABLE FILTRATION DEVICE

CROSS REFERENCE TO RELATED APPLICATION

This application claims the benefit of French Patent Application No. FR.13 60479 filed on Oct. 25, 2013, the contents of which are incorporated herein by reference.

The present invention relates to the field of swimming pool equipment. It relates more particularly to a swimming pool cleaning apparatus with filtration device that can be removed as a single block.

PREAMBLE AND PRIOR ART

The invention relates to a surface cleaning apparatus submerged in a liquid, such as a surface formed by the walls of a basin, notably of a swimming pool. It relates notably to a mobile swimming pool cleaning robot.

In this field, the patents FR 2 925 557 and 2 925 551 from the applicant are known, for example, which target a submerged surface cleaning apparatus with removable filtration device. Such devices comprise a body, members driving said body over the submerged surface, a filtration chamber formed within the body and comprising a liquid inlet, a liquid outlet, a hydraulic liquid circulation circuit between the inlet and the outlet through a filtration device. In these two patents, the filtration device is removable to make it possible to empty the leaves and other debris without having to turn over the cleaning apparatus.

The unpublished French patent application No. 10.04 604 and international PCT patent application No. US 2011/054838 describe an apparatus for filtering debris driven in a flowing fluid, characterized in that it comprises:

a. an inlet;

b. a first tube (i) defining (A) an outside, and (B) an inside region, and (ii) comprising openings through which the fluid can flow from the outside to the inside region;

c. an outlet in fluid communication with the inside region; and d. means for imparting a rotational motion on the fluid flowing through the inlet and around the outside of the first tube.

Swimming pool cleaning apparatuses are known which implement other filtration methods.

For example, the patent document EP 2 235 298 is known, which teaches a submerged surface cleaning apparatus in which a liquid undergoes a locally turbulent flow before passing through filtering walls, the debris present in the liquid sucked into the apparatus being separated by gravity in the turbulent zone.

However, in such a device, the turbulent zone does not make it possible to separate all the debris conveyed by a liquid, notably debris with a density very close to that of the liquid. In fact, the debris that should be extracted from a water, notably a swimming pool water, is generally so filled with water as to exhibit a density substantially similar to that of the water. This is particularly the case with plant leaves which have remained for several days in the water.

Because of this, the water still filled with debris passes through a filter via linear displacement from upstream to downstream such that the filter clogs up little by little, thus reducing the filtration effectiveness and above all the filtered water flow rate.

In addition, such an apparatus is almost entirely filled with water, so it is difficult to remove it from a basin because of its significant weight.

Moreover, the filter proposed by EP 2 235 298 is particularly difficult to clean because of its form.

Also known is a device described in the patent EP 1 074 678 B1 (published in February 2011). This document teaches a swimming pool cleaner comprising a filtering element of a form similar to a basket comprising a tubular central rod configured to be placed over a clean water outlet tube, said central rod being surrounded by an annular throat constituting the active filtering part of the filtering element. In this device, the dirty water arrives through the top annular part, passes through the filter in the bottom part of the basket, and leaves through the central tube including a pump. For cleaning purposes, the filtering element is removed through the top part to which it is removably fastened. The filtering element consists of a flexible bag, which closely follows the form of the internal shell.

This device exhibits, among other things, filter clogging problems, notably through leaves suspended in the water, and which gradually build up on the bottom of the filtration bag.

The aim of the invention is notably to remedy some of these drawbacks.

The invention aims to propose a swimming pool cleaning apparatus that provides an effective filtration of debris in the water.

The invention notably aims to propose such a cleaning apparatus which makes it possible to effectively separate water from the leaves that have remained in the water for a long time.

The invention also aims to propose a cleaning apparatus that provides a filtration by significantly limiting the clogging of the filter.

The invention therefore aims also to propose such a cleaning apparatus which does not overconsume electricity because of a rapid clogging of the filter.

The invention notably aims to propose such a cleaning apparatus in which the filtered water flow rate does not decrease over time between two cleanings of the filter.

The invention also aims to propose such a cleaning apparatus that requires little maintenance, notably that does not require frequent cleaning of the filter compared to the total volume of the apparatus, notably to the storage volume available for debris.

The invention also aims to propose such a cleaning apparatus that has a large debris storage capacity compared to the overall volume of the apparatus.

SUMMARY OF THE INVENTION

In a first aspect, the invention relates to a swimming pool cleaning apparatus comprising:

a body, at least one hydraulic liquid circulation circuit between at least one liquid inlet and at least one liquid outlet, and through a removable filtration device of the cleaning apparatus.

The filtration device comprises at least one filtration chamber comprising:

a cover, a filtration basket.

The hydraulic fluid circulation circuit comprises a liquid discharge tube emerging from the apparatus through an opening formed in the cover of the filtration device.

The filtration basket comprises a central filtering wall surrounding the liquid discharge tube, over at least a part of its length, which tube advantageously comprises water inlet openings in its bottom part, that is to say away from the cover, the filtration basket being produced in a single uninterrupted volume, peripheral to the central filtering wall.

In other words, the invention targets a swimming pool cleaning apparatus comprising:

a body, at least one liquid inlet situated at the base of the body and at least one liquid outlet, pumping means creating a water circulation between at least one liquid inlet and one liquid outlet and passing through at least one filtration system, a removable filtration device of the cleaning apparatus.

The filtration device comprises at least one filtration chamber comprising:

a cover, a peripheral wall defining the overall bulk of the filtration chamber that has a first opening facing the cover and a second opening, on the opposite face, leaving space for a filtering internal wall, this filtering internal wall is of axisymmetrical form and links the face opposite the cover to the latter.

In this way, the circulation of the water in the filtration basket leads to the creation of multiple swirling motions at the periphery of the central filtering wall. These swirling motions prevent the excessively fast build-up of debris on the central filtering wall, and therefore slow down the clogging of the filter. The flowrate of the cleaning robot is thus kept substantially constant for longer, and the need to remove the robot from the swimming pool to clean it is correlatively reduced.

It will be noted that the opening formed in the cover can be, but is not necessarily, situated in the central part of said cover. It is sufficient for the space between the discharge tube/central filtering wall and the rest of the filtering basket to allow liquid to pass freely to generate the swirling motions listed previously.

In a particular embodiment, the filtration basket comprises at least one side water inlet.

It will be understood that the assembly formed by the cover and the filtration basket forms a kind of torus around the liquid discharge tube, the filtration basket and the cover having a void in order to be able to be mounted around the liquid discharge tube.

The term "swimming pool cleaning apparatus" should be understood to mean an apparatus for cleaning a submerged surface, that is to say typically an apparatus, that can move around in or at the bottom of a swimming pool basin, and suitable for filtering debris deposited on a wall. Such an apparatus is commonly known by the name "swimming pool cleaning robot", when it comprises automated means for managing the movements on the bottom and over the walls of the swimming pool to cover all the surface to be cleaned.

By a misuse of language, "liquid" is used here to mean the mixture of water and debris in suspension in the swimming pool or in the fluid circulation circuit within the cleaning apparatus.

In a particular embodiment, the cover of the filtration device is securely attached in a detachable manner to the filtration basket, and comprises a handle for extracting the filtration device from the cleaning apparatus. In this way, the user removing the filtration basket from the swimming pool cleaning apparatus does not need to dirty the hands in contact with the leaves or debris contained in the filtration basket.

Advantageously, the filtration basket and the cover are extracted from the apparatus by removal from the body through the top.

In this way, the filtration basket can be extracted through the top of the apparatus. Thus, a user does not have to turn over said apparatus to extract the filtration basket. The cover therefore forms a top part of the body of the apparatus.

The cover is advantageously transparent in order to assess the filling of the debris recovery zone.

Advantageously, the filtration basket has at least one supply opening passing through its peripheral wall.

In a particular embodiment, the apparatus comprises a fluid circulation pump, arranged in the liquid discharge tube.

Advantageously, the circulation pump is an axial rotary pump with propeller. In this case, the propeller is advantageously arranged in the top part of the liquid discharge tube.

According to a particular embodiment, the central filtering wall comprises at least one cylindrical section and/or at least one truncated cone-shaped section.

In a particular embodiment, the pump axis is substantially collinear to the axis of symmetry of the central filtering wall.

In an embodiment favouring manufacturing simplicity, the filtration basket comprises, in addition to the central filtering wall, a bottom filtering wall and outer side filtering walls, thus being shaped in a rectangular parallelepiped with no top face, said face being normally formed by the cover, and comprising, in the central part, the central filtering wall oriented on an axis at right angles to its bottom face.

The parallelepipedal form of the outer wall of the basket makes it possible to best exploit the substantially rectangular form of the body of the cleaning apparatus.

It is clear, however, that the filtration basket could comprise, for example, an outer wall of cylindrical form or of any other form.

The filtration basket is, in a particular case, contained in a rigid frame. The filter, for example, consists of a rigid mesh over which a filtering fabric can be stretched.

It is even more particularly securely attached to this rigid frame. The filter then, for example, consists of a rigid mesh securely attached in a non-removable manner to the filtering fabric.

In an alternative embodiment, the filtration basket is a flexible bag.

The circulation of the liquid filled with debris around the central filtering wall before the liquid passes through the latter makes it possible to avoid the clogging of the filter, by virtue of the swirling motions generated. Because of this, the cleaning apparatus needs to be removed from the water to clean its filter less often than in the prior art.

Advantageously, the hydraulic circuit is adapted to allow a liquid circulation between at least one liquid inlet into the body and at least one liquid outlet from the body under the effect of a pumping device. The filtration device is interposed, on the hydraulic circuit, between at least one liquid inlet and at least one liquid outlet.

The invention thus makes it possible to effectively separate debris from a liquid while avoiding the clogging of a filter. In practice, since the liquid is circulated in multiple swirling motions around the central filtering wall, it detaches any debris, notably leaves, which could be pressed against the filtering section. More particularly, the debris itself which is rotated with the liquid collides with debris built up against the filtering section, so that the impact detaches the latter and returns them to circulation in the water in the filtration basket.

The central filtering wall is situated in the central zone of the filtration device.

Furthermore, the central filtering wall is advantageously overall symmetrical of revolution, that is to say that it has one (or more) section(s) of overall symmetrical revolution form, for example a combination of sections chosen from cylindrical, conical, truncated cone-shaped, and other such forms. In particular, the central filtering wall is advantageously cylindrical of revolution, that is to say that it has one (or more) section(s) of overall cylindrical revolution form, and more particularly at least one filtering section of cylindrical revolution form.

The central filtering wall has, in a particular embodiment, at least one main axis of symmetry.

In order to ensure an effective filtration of the liquid, the axis of symmetry of the central filtering wall advantageously forms an angle less than 45° with the normal to the guiding plane. According to certain embodiments, the axis of the central filtering wall is at least substantially vertical when the apparatus is placed on a horizontal surface, such that the angle between the axis of the central filtering wall and the vertical is less than 45°, notably less than 30°, for most of the swimming pool basin bottom surfaces.

In a particular embodiment, the axis of symmetry of the central filtering wall is arranged substantially orthogonal to the guiding plane of the apparatus.

In a particular embodiment, the apparatus has a hydraulic circuit comprising a single liquid inlet into the body. The apparatus advantageously has a hydraulic circuit comprising a single liquid outlet from the body.

An apparatus as described advantageously also comprises a motor-driven circulation pump situated in the body and adapted to be able to create a liquid circulation in said hydraulic circuit.

Furthermore, advantageously, the circulation pump axis is substantially collinear to the axis of symmetry of the central filtering wall.

Furthermore, the circulation pump is advantageously screened in a fairing coaxial to the central filtering wall. The fairing is, for example, securely attached to the body.

The fairing is hydraulically linked to at least one liquid outlet from the body. The fairing is advantageously pierced with at least one liquid discharge opening designed to be able to discharge a liquid contained in the filtration chamber.

The propeller of the circulation pump is, for example, arranged in a downstream portion of the tubular wall, and more particularly downstream of at least one filtration chamber discharge opening, notably and advantageously between each discharge opening and a liquid outlet from the body.

The circulation pump is, for example, situated immediately upstream of the liquid outlet from the body. The circulation pump therefore ensures a circulation of liquid in the hydraulic circuit by suction.

Advantageously, the cleaning apparatus comprises means suitable for being able to impart on a liquid charged with leaves circulating around the central filtering wall swirling motions at a sufficient speed to, at least for certain leaves, counter the forces having a tendency to attract the leaves towards said central filtering wall.

The pump is notably of sufficient power to obtain this result. Furthermore, the form, the dimensions and the orientation of each supply opening into the filtration chamber are designed to obtain this result. The form and the dimensions of the filtration chamber, notably of its peripheral wall, and the form and the dimensions of the tubular wall, notably of the top filtering section, are also chosen to obtain this result. Numerous combinations of these different features are possible to obtain said result.

The invention also relates to a submerged surface cleaning apparatus, characterized in combination by all or some of the features mentioned above or below.

PRESENTATION OF THE FIGURES

The features and advantages of the invention will be better appreciated from the following description, a description which explains the features of the invention through a nonlimiting exemplary application.

Figure 2:
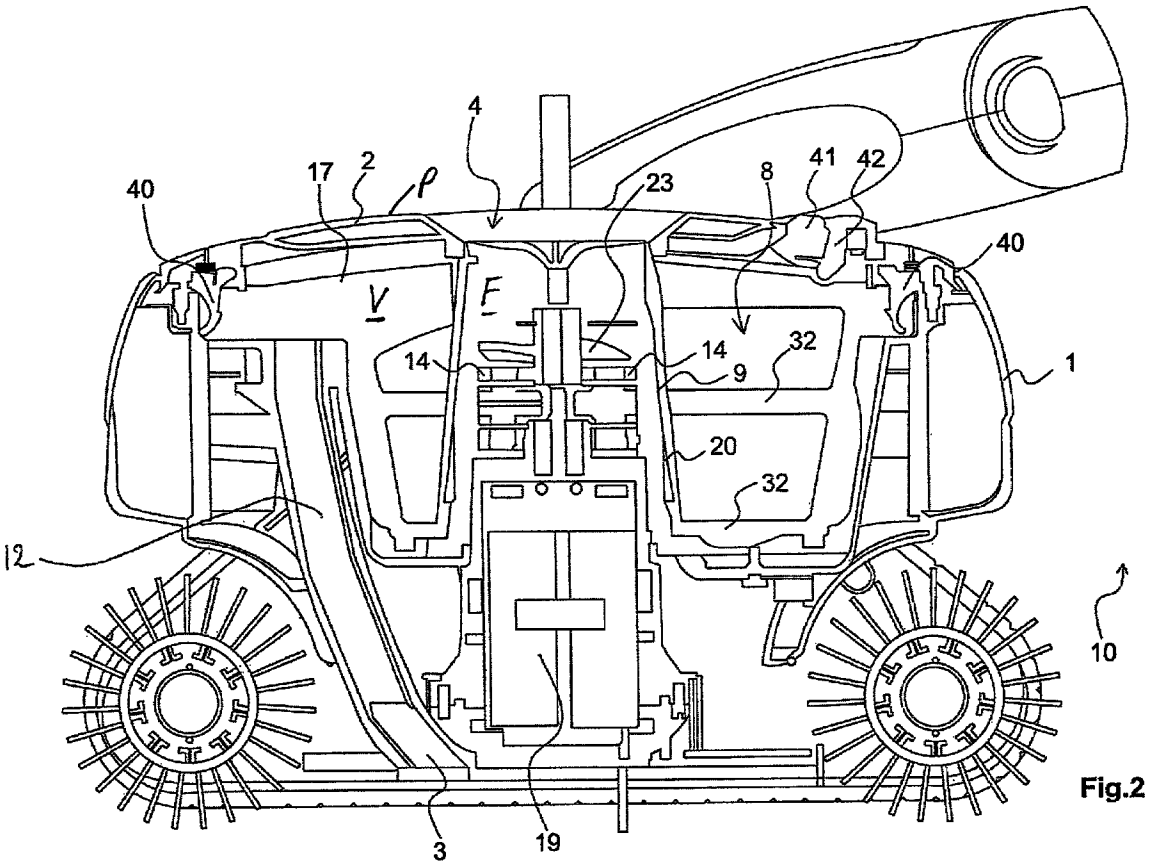
Figure 3:
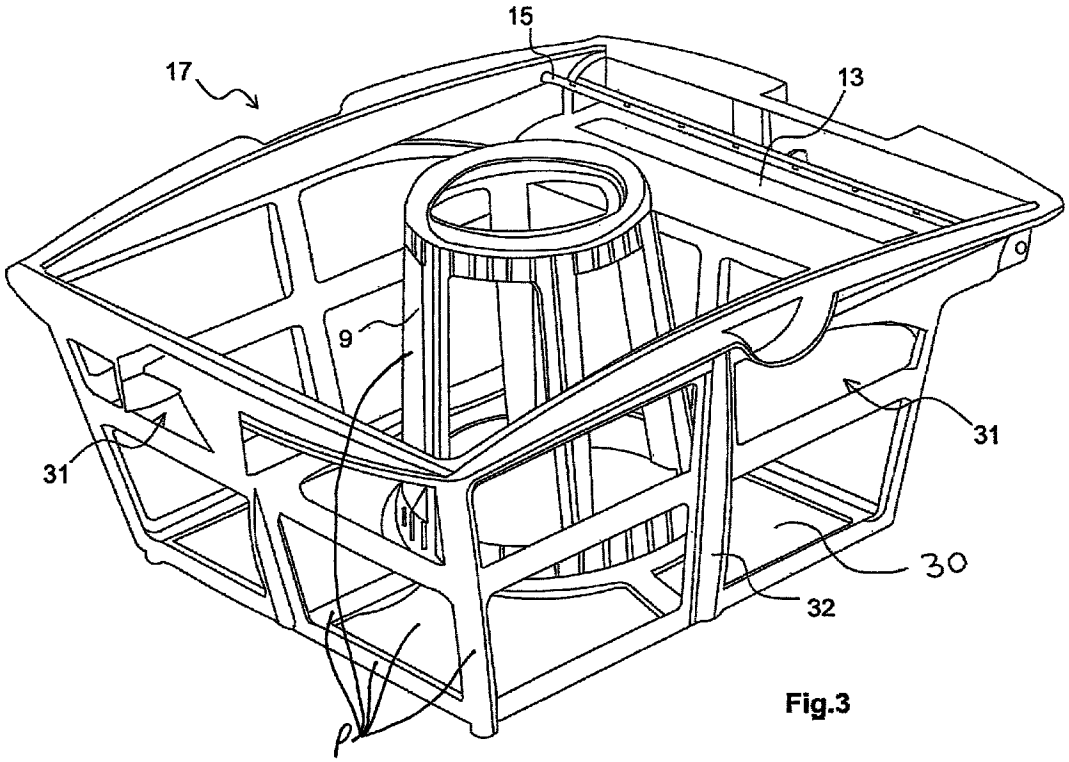
Figure 4:
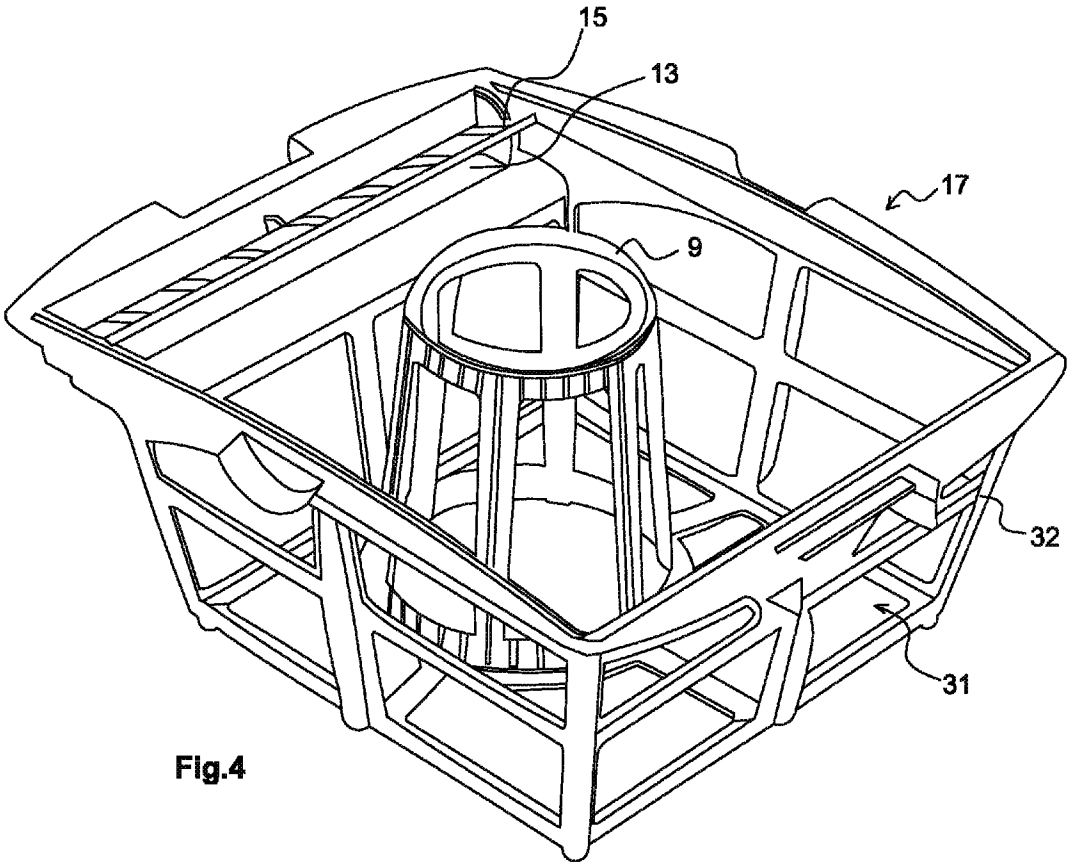
Figure 5:
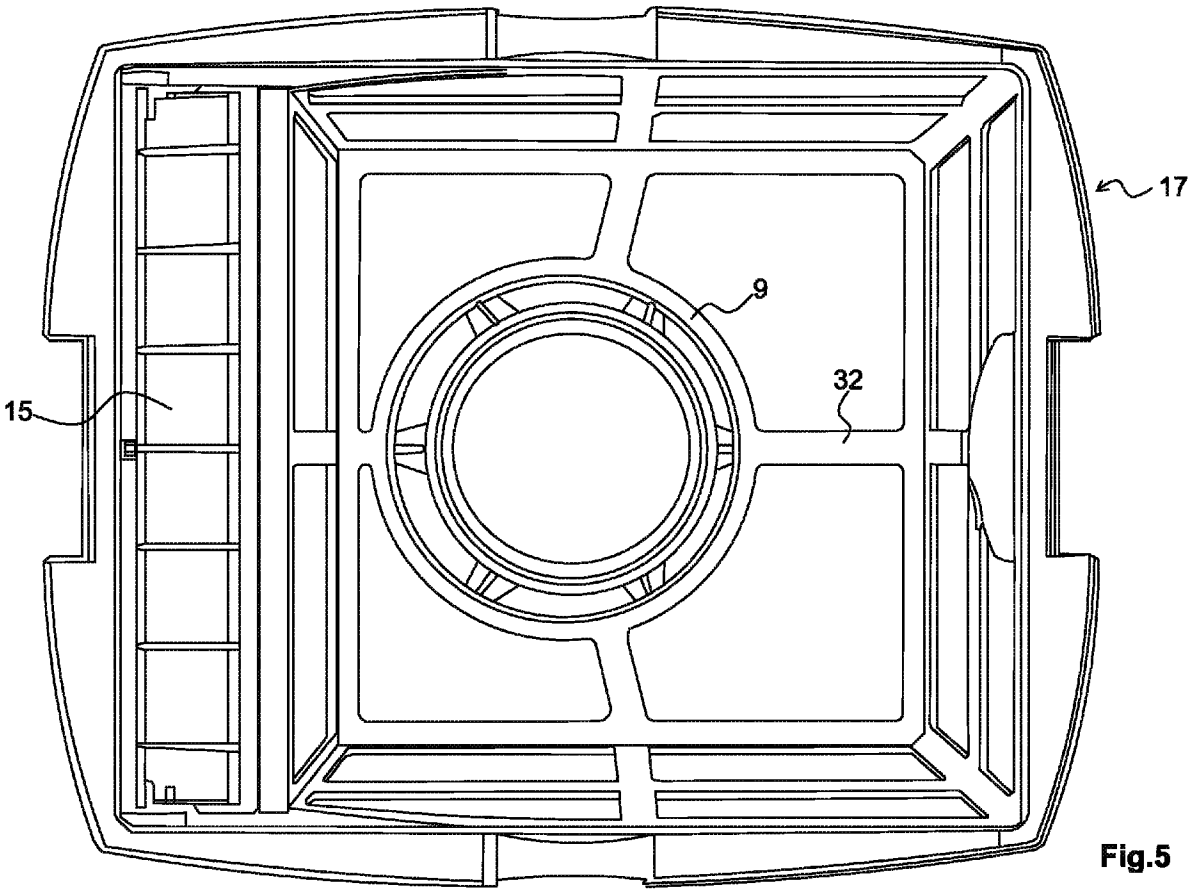
Figure 6:
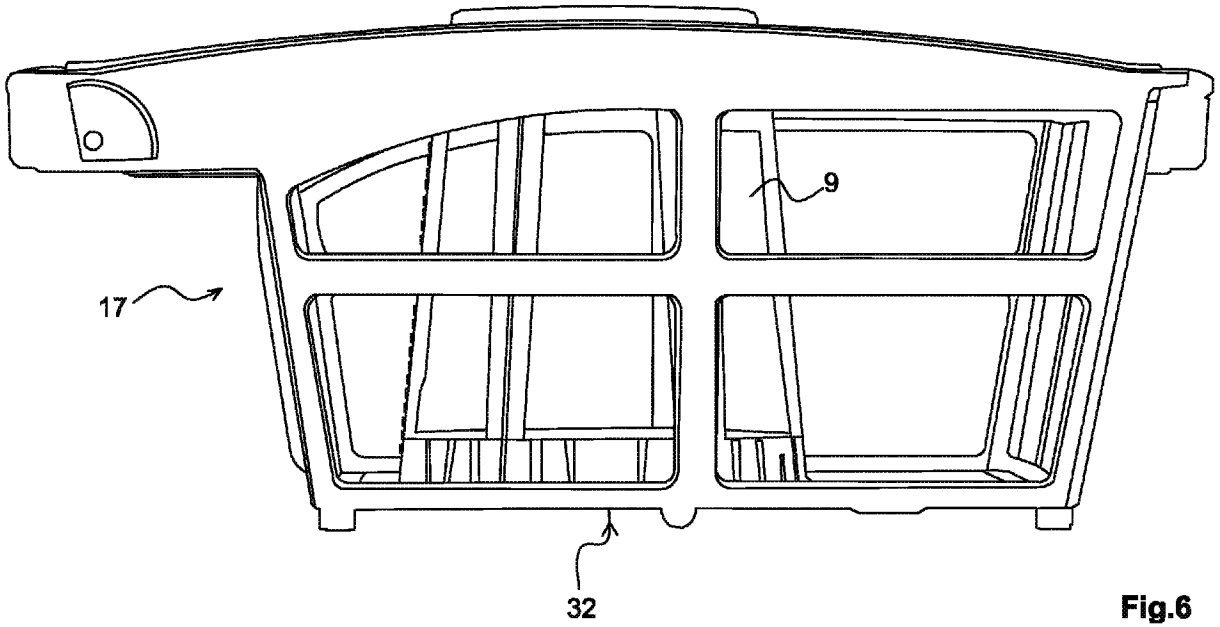

The description is based on the attached figures in which:

FIG. 1 illustrates a perspective view of a swimming pool apparatus implementing a filtration system as described, FIG. 2 illustrates a cross-sectional view of the same apparatus on a longitudinal vertical plane, FIGS. 3 and 4 are perspective views of a filtration basket adapted to the apparatus of FIG. 1, FIG. 5 is a schematic plan view of the same basket, FIG. 6 is a side view of this same filtration basket.

DETAILED DESCRIPTION OF AN EMBODIMENT OF THE INVENTION

The invention relates to a technical swimming pool environment, for example a family pool dug in the ground.

A submerged surface cleaning apparatus is thus represented according to an embodiment given here as a nonlimiting example, in FIGS. 1 to 6.

The swimming pool cleaning apparatus comprises a body 1 and a driving and guiding device comprising members for driving and guiding the body (tracks arranged laterally to the body in FIG. 1) over a submerged surface.

The driving and guiding members define a guiding plane on a submerged surface by their points of contact with said submerged surface. Said guiding plane is generally substantially tangential to the submerged surface at the point where the apparatus is located. Said guiding plane is, for example, substantially horizontal when the apparatus is moving over a submerged swimming pool bottom surface.

Throughout the text, the concepts of "top" and "bottom" are defined along a straight line normal to said guiding plane, a "bottom" element being closer to the guiding plane than a "top" element.

The device also comprises a motor driving said driving and guiding members, said motor being powered via a cable.

The swimming pool cleaning apparatus has at least one liquid inlet 3 and one liquid outlet 4. The liquid inlet 3 is, in the present nonlimiting example, situated at the base of the body (in other words, under the latter), that is to say immediately facing a submerged surface over which the apparatus is moving in order to be able to suck up the debris built up on said submerged surface. The liquid outlet 4 is situated on the top of the apparatus.

In the present exemplary embodiment, the liquid outlet is formed in a direction substantially at right angles to the guiding plane, that is to say vertically if the cleaning apparatus is resting on the bottom of the swimming pool.

The apparatus comprises a hydraulic circuit linking the liquid inlet 3 to the liquid outlet 4. The hydraulic circuit is designed to be able to ensure a circulation of liquid from the liquid inlet 3 to the liquid outlet 4. The apparatus to this end comprises a pump comprising a motor 19 and a propeller 23

(see FIG. 2), said motor 19 driving the propeller 23 in rotation, said propeller 23 being arranged in the hydraulic circuit. The propeller 23 is arranged here above the motor 19, the latter being fastened to the body 1 in a fairing with its axis of rotation 10 orthogonal to the guiding plane.

In particular, the propeller 23 is arranged downstream of the hydraulic circuit—that is to say just upstream of the liquid outlet 4—in a tubular fairing 20, the top end of which emerges on the top surface of the apparatus and forms said liquid outlet 4. The fairing 20 has a plurality of discharge openings 14 through which the liquid contained in the filtration chamber 8 is discharged. Said discharge openings 14 are produced in the fairing 20 of the propeller 23, all around the latter, and are hydraulically linked to the liquid outlet 4.

The electric motor 19 drives the propeller 23 of the circulation pump and the driving and guiding device.

The apparatus comprises a filtration chamber 8 interposed, on the hydraulic circuit, between the liquid inlet 3 and the liquid outlet 4. The filtration chamber is in particular supplied with liquid via at least one upstream channel 12 linking the liquid inlet 3 to the filtration chamber 8. Each upstream channel 12 emerges in the filtration chamber 8 through a supply opening 13. The supply opening 13 is here provided with a non-return valve 15.

The filtration chamber 8 comprises a filtration basket 17 and a cover 2 forming the top wall of the filtration chamber 8.

The filtration basket 17 forms the bottom and the outer and inner peripheral walls (the central filtering wall 9) of the filtration chamber 8.

The filtration chamber 8 is in fact delimited inside by a central filtering wall 9 of the filtration basket 17, through which the liquid contained in the filtration chamber 8 is discharged. To this end, the filtering wall 9 delimits an internal volume F, called internal volume of the filtering wall 9, within which said liquid discharging is performed.

The bottom, and the outer and inner walls of the filtration basket 17, on the one hand, and the cover 2, described in more detail hereinbelow and forming the top wall of said filtration basket 17, on the other hand, form a set, denoted P, of walls delimiting an internal volume V, called internal volume of the filtration basket 17, intended to accommodate the liquid routed by said at least one upstream channel 12 through said supply opening 13.

Hereinafter in the description, said internal volumes V and F, when they do not contain a liquid, are seen as continua of intangible points. There are thus defined, in the mathematical sense, two sets:

- a first set containing all the continuous paths, linking any two intangible points of said internal volume V, and remaining entirely contained in said internal volume V,
- a second set containing all the continuous paths of minimal lengths, linking any two intangible points of said internal volume V, and not intersecting the volume F.

It is clear that the configuration of the set P, that is to say the relative position of the walls belonging to said set P, has an impact on the topology of the paths contained in the first set. In the present nonlimiting implementation, the set P is configured so that the second set is contained, from a set viewpoint, in the first set. In other words, the volume V receiving debris formed by the filtration basket does not include any vertical separator delimiting sub-volumes in said basket. The debris can circulate freely within or at the bottom of the filtration basket, and is not retained in local bowls of said basket. The basket completely peripherally surrounds the central filtering wall. In this way, the water can circulate freely around the central filtering wall, in a spiral or swirling motion for example around this wall.

In a variant embodiment, the basket comprises a vertical separator over a minor part (significantly less than half) of the height of the volume of the basket.

Such a basket configuration is advantageous, because it makes it possible to have a filtration volume V of maximum capacity, given the rigid structure of the filtration chamber 8. In this way, a greater quantity of liquid can be loaded in the body 1 and the liquid can circulate freely, that is to say without encountering material obstacles, around the central filtering wall 9, accordingly reducing the energy needed to move it in the hydraulic circuit. As indicated above, the filtration basket 17 is shaped in a single volume peripheral to the central filtering wall 9 and does not comprise any internal "wall" interrupting this volume or delimiting a plurality of bowls forming local filtration zones.

Furthermore, the fact of having a volume V of maximum capacity makes it possible, in an alternative implementation comprising a supply opening 13 configured in such a way that the liquid penetrates in a direction substantially tangential to at least one of the outer walls of the filtration basket 17, to optimize the formation of swirling movements around the filtering wall 9. Such swirling movements make it possible, on the one hand, to clear away debris which may be stuck to said central filtering wall 9, and, on the other hand, to keep the debris in suspension away from the filtering walls, so that the filter cannot be blocked.

The filtration basket 17 has an overall parallelepipedal form, with a void on either side formed by the central filtering wall 9, intended to be placed around the fairing 20 of the propeller 23 and of the electric motor. The filtration basket 17 in fact comprises, in addition to the central filtering wall 9, a bottom filtering wall 30 and outer side filtering walls 31, thus being shaped in a rectangular parallelepiped with no top face, said face being normally formed by the cover 2, said filtration basket 17 comprising in the central part, the central filtering wall 9 oriented on an axis at right angles to its bottom face 30, this axis here being merged with the vertical axis 10 of the cleaning apparatus.

It will be understood that this arrangement allows for a favourable circulation of the dirty water in the filtration basket, and maximizes the surface area of the central filtering wall compared to the case of a filtration basket comprising a number of sub-volumes.

In the present exemplary embodiment, the central filtering wall 9 is truncated cone-shaped, wider in the bottom part than in the top part (close to the cover 2). The central filtering wall 9 is here filtering over practically all of its height, but in variants, it can be filtering only over a part of its height.

The filtration basket 17 comprises an actual filter, attached by welding, bonding or any other means, to an openwork rigid frame 32.

The size of the filter mesh is naturally suited to the size of the particles that the cleaning apparatus has to retain in its movement in the swimming pool.

The filtration basket 17 is extractable, that is to say that it can be extracted from, and introduced into, the body 1 of the apparatus. The body 1 of the apparatus to this end has a housing in which the filtration basket 17 can be mounted. The fact that the filtration basket 17 is extractable makes it possible to empty it easily, notably without having to handle the apparatus as a whole.

The filtration basket 17 is associated with a cover 2, which is removable in order to facilitate the cleaning of the filtration basket 17 of the debris built up therein.

The cover 2 is mounted hermetically on the filtration basket 17 in order to avoid leaks of debris-filled liquid. The cover 2 forms a top portion of the outer wall of the apparatus when the filtration basket 17 is inserted into the housing of the apparatus. The cover 2 has a form corresponding to the lateral form of the filtration basket 17, pierced at its centre in order to form a passage to the fairing 20 of the propeller 23 forming, by its top end, the liquid outlet 4.

In the present embodiment, the cover 2 comprises a locking means on the top of the filtration basket 17, in the form of two snugs 40 (see FIG. 2) comprising return means that close over the top longitudinal edges of the filtration basket 17.

The cover also comprises a locking means on the body 1, in the form of two lateral sliders in the form of a circular arc which cooperate, on the one hand, with corresponding sliders formed in the top lateral edges of the body 1 and, on the other hand, with an extraction handle 41 (see FIG. 2). In this way, when the extraction handle 41 is lifted by the user, the cover 2 and the basket 17 can be extracted from the body 1. The handle 41 is itself locked by a snug 42 (see FIG. 2) on the cover 2 when the basket is inserted into the body 1, so as to avoid having the filtration basket 17 risk being moved when the apparatus is in operation.

It should be noted that, in this way, the user does not need to touch the debris when extracting it from the assembly formed by the filtration basket and the cover. He or she can move this assembly to the place where he or she will carry out the cleaning and, only at that place, remove the cover and turn over the basket to empty it. Throughout these procedures, the user has no direct contact with the dirt contained in the filtration basket. Such a result is not obtained with the devices in which the cover is removed first, and then the user has to manipulate the open basket to remove it from the body of the cleaning robot. In this second case, the direct contact of the user with the dirt is practically inevitable, which creates inconvenience of use.

The filtration chamber 8 also comprises a central filtration wall 9 forming an integral part of the filtration basket 17. The central filtration wall 9 makes it possible to retain debris of a size greater than the openings (or pores) of said filtering wall.

This central filtering wall 9 is substantially cylindrical or truncated cone-shaped. It is positioned, when the filtration basket 17 is incorporated in the body 1 of the swimming pool cleaning apparatus, around the motor and the propeller of the pumping circuit. This motor and this propeller 23 determine an axis 10, here called vertical axis, at right angles to the guiding plane, that is to say substantially vertical when the apparatus is resting on a horizontal submerged surface. As has been stated, the concepts of "top" and "bottom" are determined along this axis 10 relative to a surface on which the apparatus is placed via its driving and guiding device.

The supply openings are situated in a top portion of the filtration chamber 8.

The filtration chamber 8 is configured to be able to impart on the liquid multiple swirling motions around the central filtration wall 9, these motions having a substantially vertical axis.

Variants

In a variant embodiment, an apparatus according to the invention does not include its own pump and is linked to an external hydraulic circuit, for example external to a swimming pool basin, comprising a pump and creating a suction at the end of a pipe that can be coupled to the hydraulic circuit of the apparatus, for example at its liquid outlet.

In another variant, the filtration chamber can comprise elements making it possible to modify the direction of flow of a liquid in the filtration chamber, for example an arrangement of blades, fixed blades, walls creating local turbulences, etc.

Furthermore, the upstream channels can be configured to introduce the liquid downwards from the filtration chamber.

The invention claimed is:

1. Swimming pool cleaning apparatus comprising:

a body, and at least one hydraulic liquid circulation circuit between at least one liquid inlet and at least one liquid outlet, and through a removable filtration device of the cleaning apparatus, and wherein the filtration device comprises at least one filtration chamber comprising:

a cover, and a filtration basket, the hydraulic fluid circulation circuit comprising a liquid discharge tube emerging from the apparatus through an opening formed in the cover of the filtration device, the filtration basket comprising a central filtering wall surrounding the liquid discharge tube over at least a part of its length, the filtration basket being shaped in a single uninterrupted volume, peripheral to the central filtering wall, and the cover comprising an extraction handle and being attached to the filtration basket so that the filtration device is configured for removal from the body as a unit.

2. The apparatus of claim 1, wherein the tube comprises water inlet openings in its bottom part, away from the cover.

3. The apparatus of claim 1, wherein the filtration basket comprises at least one side water inlet.

4. The apparatus of claim 1, comprising a fluid circulation pump arranged in the liquid discharge tube.

5. The apparatus of claim 1, wherein the circulation pump is an axial rotary pump with propeller.

6. The apparatus of claim 1, wherein the propeller is arranged in the top part of the liquid discharge tube.

7. The apparatus of claim 1, wherein the central filtering wall comprises at least one cylindrical section.

8. The apparatus of claim 7, wherein the pump axis is substantially collinear to the axis of symmetry of the central filtering wall.

9. The apparatus of claim 1, wherein the central filtering wall comprises at least one truncated cone-shaped section.

10. The apparatus of claim 1, wherein the filtration basket further comprises a bottom filtering wall and outer side filtering walls, thus being shaped in a rectangular parallelepiped with no top face, said face being normally formed by the cover, and comprising, in the central part, the central filtering wall oriented on an axis at right angles to its bottom face.

11. The apparatus of claim 1, wherein the filtration basket is contained in a rigid frame.

12. The apparatus of claim 11, wherein the filtration basket is securely attached to the rigid frame.

13. The apparatus of claim 1, comprising means suitable for being able to impart on a liquid filled with leaves circulating around the central filtering wall swirling motions at a sufficient speed to, at least for certain leaves, counter the forces having a tendency to attract the leaves towards said central filtering wall.

14. A swimming pool cleaning apparatus comprising:

a. a body defining an inlet and an outlet between which water may flow;

b. means for causing debris-laden pool water to flow in a water flow path from the inlet to the outlet; and c. a filtration basket (i) interposed in the water flow path, (ii) having at least one rectangular cross-section, and (iii) comprising (A) a central filtering wall, (B) a bottom filtering wall, and (C) a plurality of side filtering walls.

15. The swimming pool cleaning apparatus of claim 14 in which the pool water flow-causing means comprises a propeller, further comprising a fairing (i) housing the propeller and (ii) abutted by the central filtering wall.

16. The swimming pool cleaning apparatus of claim 15 in which the fairing (i) is generally tubular in shape and (ii) comprises circumferential discharge openings.

17. The swimming pool cleaning apparatus of claim 14 further comprising a cover configured for attachment to the filtration basket so as to be removable with the filtration basket as a unit from the body.

18. The swimming pool cleaning apparatus of claim 17 in which the cover is detachable from the filtration basket so as to allow debris to be emptied therefrom.

19. The swimming pool cleaning apparatus of 14 in which the filtration basket further comprises (i) a supply opening in liquid communication with the inlet and (ii) a non-return valve.

20. A filtration basket for a swimming pool cleaning apparatus, comprising:

a. a bottom filtering wall, at least a portion of which is generally rectangular in shape;

b. a central filtering wall, at least a portion of which is generally in the shape of a truncated cone, extending from the bottom filtering wall; and c. side filtering walls (i) extending from the bottom filtering wall and (ii) surrounding at least the majority of the central filtering wall.

21. The filtration basket of claim 20 further comprising:

a. a supply opening; and b. a non-return valve associated with the supply opening.

22. The filtration basket of claim 20 in which the bottom filtering wall, the central filtering wall, and the side filtering walls form an open-work rigid frame, further comprising filter mesh attached to the open-work rigid frame.

* * * * *